US005816957A

United States Patent [19]

Dadbeh

[11] Patent Number: 5,816,957

[45] Date of Patent: Oct. 6, 1998

[54] COMPACT COLLAPSIBLE TENNIS TABLE

[76] Inventor: Bemanali H. Dadbeh, 617 Taper Dr., Seal Beach, Calif. 90740

[21] Appl. No.: 752,975

[22] Filed: Dec. 2, 1996

[51] Int. Cl.[6] ..... A63B 61/00

[52] U.S. Cl. ..... 473/496

[58] Field of Search ..... 473/496; 108/99, 108/170, 175, 179, 190, 156

[56] References Cited

U.S. PATENT DOCUMENTS

| | | | |
|---|---|---|---|
| 1,757,260 | 5/1930 | Silverman | 473/496 |
| 3,190,649 | 6/1965 | Heisler | 473/496 |
| 3,830,495 | 8/1974 | Hill | 473/496 |
| 4,762,321 | 8/1988 | Chang | 473/496 |
| 5,613,457 | 3/1997 | Wagner | 108/170 |

*Primary Examiner*—Theatrice Brown
*Attorney, Agent, or Firm*—Irving Keschner

[57] ABSTRACT

A collapsible tennis table having first and second table portions and a lower pair of parallel frame members having wheels or casters thereon. The parallel members are connected together by a elongated member, the elongated member being connected to the parallel frame members by wing nuts and bolts. Also mounted to the outside edge of both frame members are bracket members having shortened tubular members extending therefrom at a predetermined angle. Each table portion has a pair of leg extensions attached to the bottom surface thereof and a pair of brackets supporting a U-shaped tubular member. A pair of clip members are fastened to the bottom surface of each table portion and the leg portions of the U-shaped tubular member are positioned therein. In order to assemble the collapsible table of the present invention, the ends of the U-shaped tubular members are positioned in their corresponding shortened tubular members extending from the frame member brackets. The bracket members are configured such that when the table portions are pulled down to its unfolded position, the U-shaped tubular member is able to extend only to a predetermined angular position. Further movement of the table portions towards the opened position causes the legs of the U-shaped member to be removed from the clip members allowing the table to be fully extended to its opened position. The tennis net is attached to a vertical portion of a U-shaped bracket, the recessed portion of which is adapted to engage the edges of the first and second table portions. When it is desired to collapse the tennis table, the vertical bracket portion is pivoted in a manner where the net lies substantially flat adjacent to the surface of the one of the table portions, and the U-shaped bracket is moved to either side of the facing edges of the first and second table portions, enabling the table portions to be folded such that each table portion extends at an angle to the vertical.

13 Claims, 10 Drawing Sheets

COMPACT COLLAPSIBLE TENNIS TABLE

BACKGROUND OF THE INVENTION

1. Field of the Invention

The present invention relates to a collapsible tennis table which is relatively simple in construction and wherein, when folded, provides a compact unit for shipping and storage purposes.

2. Description of the Prior Art

Collapsible or foldable tables, such as hobby and game tables, and tennis tables are well known. Many of these are designed with wheels or casters to facilitate movement and to occupy smaller storage areas. In order to provide for the collapsibility feature, the prior art tables include a number of complex parts which are relatively expensive. To accommodate smaller shipping sizes, the prior tables are typically unassembled. In this case, assembly can take a number of hours and require at least two people. Further, a large number of parts are involved in partially assembled tables. In many cases, parts such as bolts and nuts are missing or lost and customers cannot assemble a table and generally become frustrated. A frustrated customer tends to call the store from which the table is purchased or the manufacturer themselves. To assemble the table also requires a number of tools, some of which are not available in the average household. Some manufacturers ship fully assembled tables to customers requiring substantially large packaging and higher shipping costs. For example, U.S. Pat. No. 4,911,085 discloses a collapsible table which is relatively large in size even after it is collapsed. Large assembled units are difficult to deliver to a number of dwellings with a recreation room in the basement or off an indirect hallway. At times, it is required to disassemble the table to take it to the place of intended use. The opening and closing of the table requires a number of steps such as locking, unlocking, pushing together and pulling apart. These steps must be taken in a precise sequence. If the sequence is missed, it can cause serious injury to the user and damage property. Many of the prior art collapsible tables have a high profile and require a relatively tall person with some physical strength to open and close the table, making it difficult, if not impractical, for a young child or a chair-bound handicapped person to operate the table. There is also the inconvenience of attaching and disassembling the net and bracket on the tennis table. Although some tables leave the net and bracket attached to the table when folding and storing, the bracket extends outwardly enough to be hazardous.

What is thus desired is to provide a collapsible table which is easy to assemble, is relatively inexpensive, enables the young person and handicapped to have access to the table, and wherein the net and bracket is basically attached to the table when it is folded and stored, the bracket being positioned in a manner not to be hazardous to persons nearby.

SUMMARY OF THE PRESENT INVENTION

The present invention provides a tennis table that is collapsible into a relatively small profile, or configuration, partially assembled for shipment or storage purposes. The table can be fully assembled without any tools relatively quickly. The table is capable of being opened and closed with a relatively small amount of force and has a low profile, both height and lengthwise, in both the disassembled and operational modes. The table is configured so that it is relatively easy to be operated by a young person and physically restricted persons. The net and the net post, or bracket, folds and stays with the table in storage, the bracket being positioned in a manner not to injure persons adjacent thereto.

In particular, the collapsible tennis table of the present invention comprises first and second table portions and a wheel base unit comprising a lower pair of parallel frame members having wheels or casters thereon, the parallel members being connected together by a elongated member, the elongated member in turn being connected to the parallel frame members by wing nuts and bolts. Also mounted to the outside edge of both frame members are bracket members having shortened tubular members extending therefrom at a predetermined angle. Each table portion has a pair of leg extensions attached to the bottom surface thereof and a pair of brackets supporting a U-shaped tubular member. A pair of clip members are fastened to the bottom surface of each table portion and the leg portions of the U-shaped tubular member are positioned therein. In order to assemble the collapsible table of the present invention, the ends of the U-shaped tubular members are positioned in their corresponding shortened tubular members extending from the frame member brackets. The bracket members are configured such that when the table portions are pulled down towards its unfolded position, the U-shaped tubular member is able to extend only to a predetermined angular position. Further movement of the table portions towards the opened, or unfolded, position causes the legs of the U-shaped member to be removed from the clip members allowing the table to be fully extended to its opened position. This dual movement allows the table portions to slowly and easily be placed in its opened position without the possibility that the weight of the table could injure somebody if otherwise configured to go from its fully closed, or folded, position to the open position in one movement, typical in prior art collapsible tables. The tennis net is attached to a vertical portion of a U-shaped bracket, the recessed, or channel, portion of which is adapted to engage the edges of the first and second table portions. When it is desired to collapse the tennis table, the vertical bracket portion is pivoted in a manner where the net lies substantially flat adjacent to the surface of one of the table portions, and the U-shaped bracket is moved to either side of the facing edges of the first and second table portions, enabling the table portions to be folded such that each table portion extends at an angle to the vertical. In the operational playing mode, the vertical bracket portion is moved to the vertical direction and the U-shaped bracket is moved to a position where it bridges the small gap between the facing edges of both table portions, the bracket then being secured in place. The vertical leg portions secured to the bottom surface of each table portion are optional since the tennis table of the present invention is configured to be supported solely by the U-shaped tubular members extending from the bottom surface of each table portion.

The present invention thus provides a collapsible tennis table which is partially assembled when shipped, does not require many parts and when unpackaged is easy to assemble without tools, and wherein the table is unfolded to the playing position in two movements, enabling the table to come to the playing position slowly and easily, minimizing the possibility of injuring someone during the process. For the convenience of the players and the those assembling the table, the net is permanently affixed to the table so that it does not have to be removed when the table is collapsed for storage purposes. The net bracket also provides an additional coupling support for the two adjacent table portions in a first embodiment.

The collapsible table of the present invention is thus easy to assemble, can be stored easily because of its low profile and can be placed in its unfolded, or operating position, slowly and with less force than other available tennis tables. The table can be disassembled into two halves and the wheel base unit thus making it easier to transport the disassembled unit to a park or other event and easily assembling the unit for play as set forth hereinabove.

DESCRIPTION OF THE DRAWING

For a better understanding of the invention as well as other objects and further features thereof, reference is made to the following description which is to be read in conjunction with the accompanying drawing wherein.

DESCRIPTION OF THE INVENTION

Figure 1:
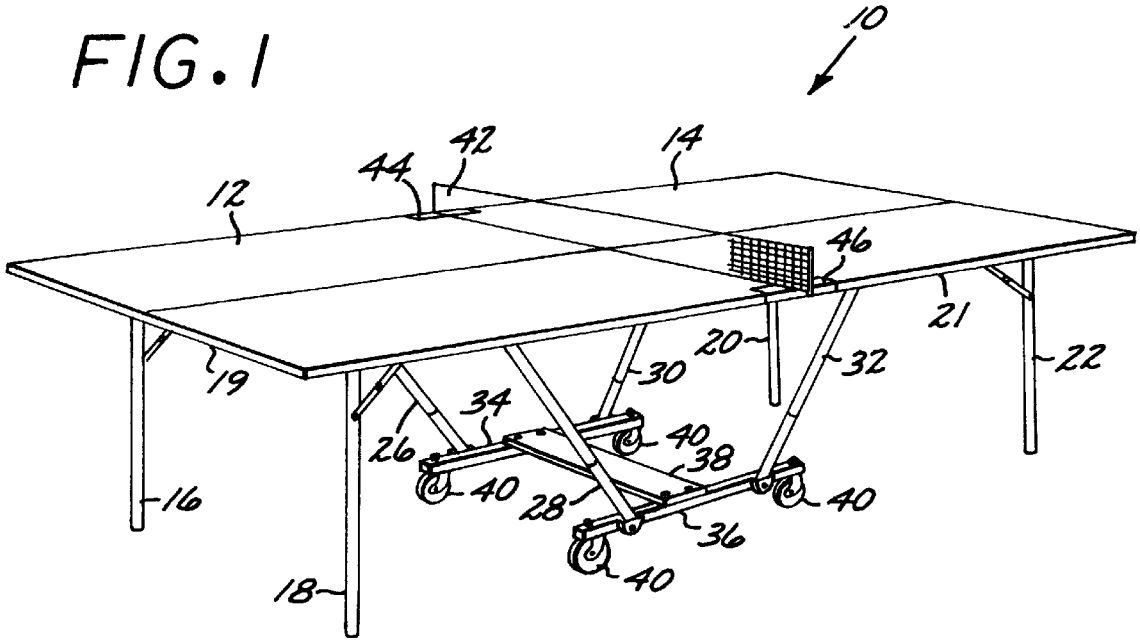
FIG. 1 is a perspective view of the collapsible table of the present invention in an unfolded state.

Referring now to FIG. 1, a perspective view of the collapsible table 10 of the present invention in the fully unfolded position is illustrated. Although the invention can be used with varying types of collapsible tables, the present invention is primarily directed to a collapsible tennis table. The table tennis table 10 comprises a first table portion 12 and a second table portion 14. Pivotable support legs 16 and 18 are connected to the bottom surface 19 of table portion 12 and collapsible legs 20 and 22 are connected to the bottom surface 21 of table portion 14. A pair of tubular leg portions 26 and 28 extend at an angle from the bottom surface 19 of table portion 12 as illustrated and a second pair of leg portions 30 and 32 extend at an angle from the bottom surface 21 of table portion 14 as illustrated. A pair of parallel members extending frame members 34 and 36 are joined together by a connecting member 38 as illustrated. Swivelling roller members, or casters, 40 are positioned at the bottom of the parallel rail members 34 and 36 allowing table 10 to be moved to a desired location. Tennis net 42 is joined to bracket members 44 and 46 in a manner set forth hereinafter, allowing the net to be permanently maintained on the table even in its foldable, or collapsed, state, and also providing an additional support to table 10 across the gap between the facing edges of table portions 12 and 14.

Figure 2:
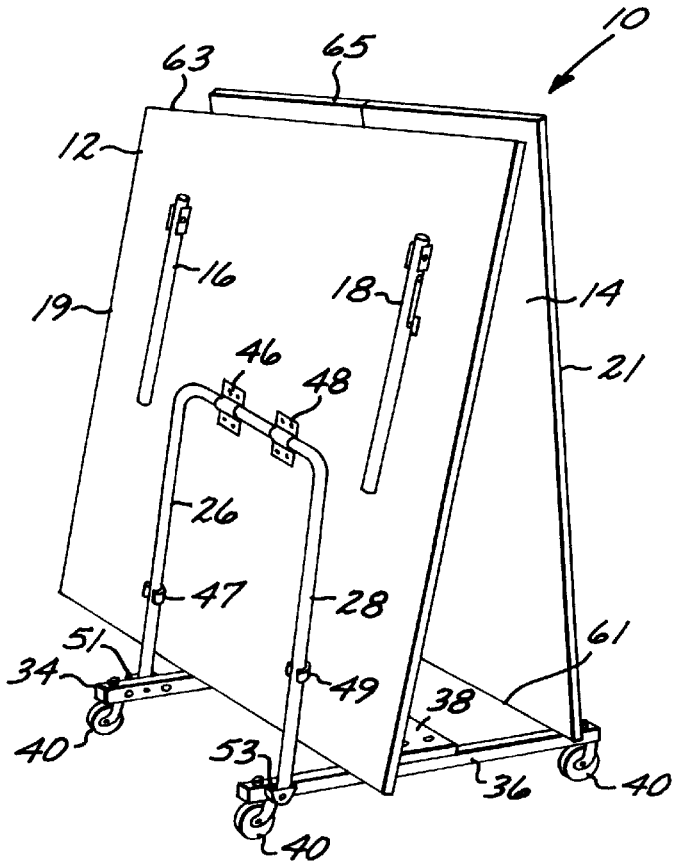
FIG. 2 is a perspective view of the present invention in a folded state.

FIG. 2 shows table 10 in its folded position. As illustrated, legs 16 and 18 are folded such that they are adjacent to the bottom surface 19 of table portion 12. Tubular members 26 and 28 are pivotable about brackets 46 and 48, respectively, and are also shown secured by clip pins 47 and 49, respectively. The bottom surface 21 of table portion 14 has a similar arrangement, although not visible in FIG. 2. As shown, table portion 12 extends upwardly at an angle determined by brackets 51 and 53.

Figure 3:
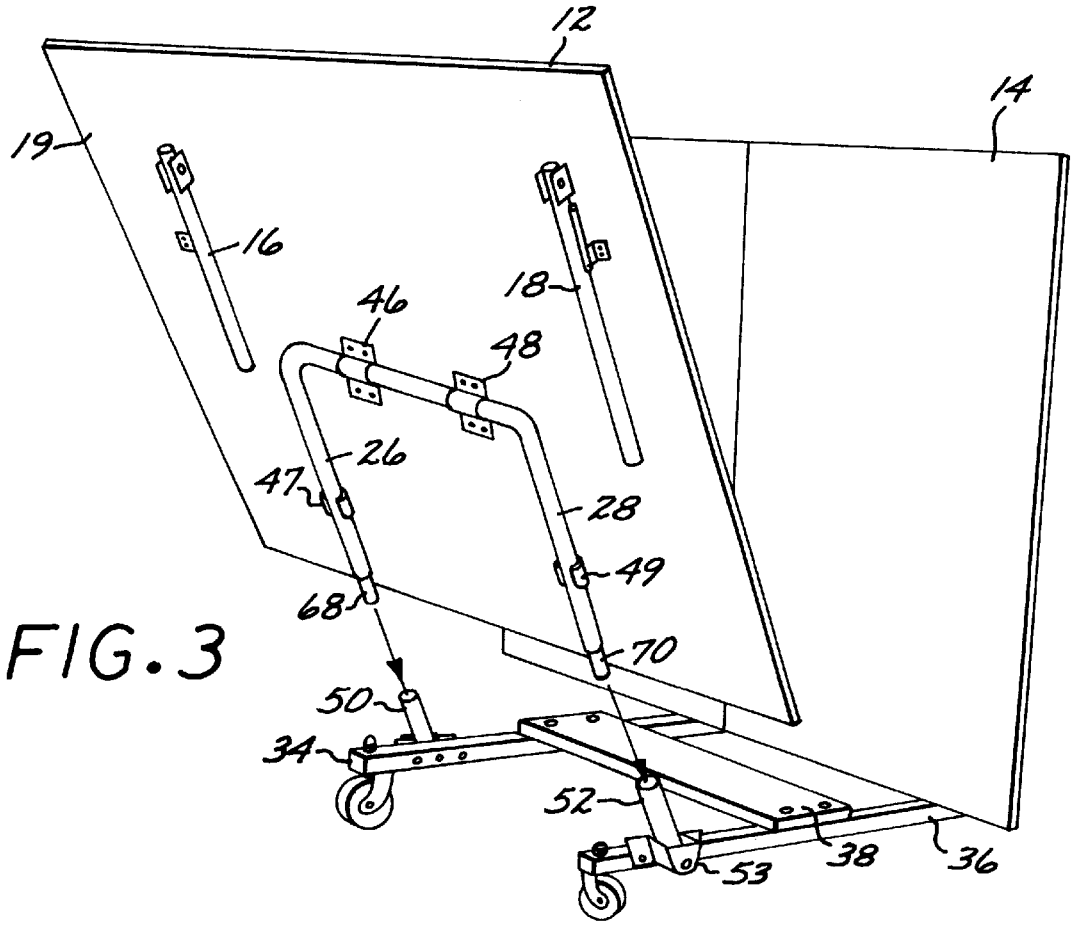
FIG. 3 is a perspective view of the present invention during the assembly step.
Figure 4:
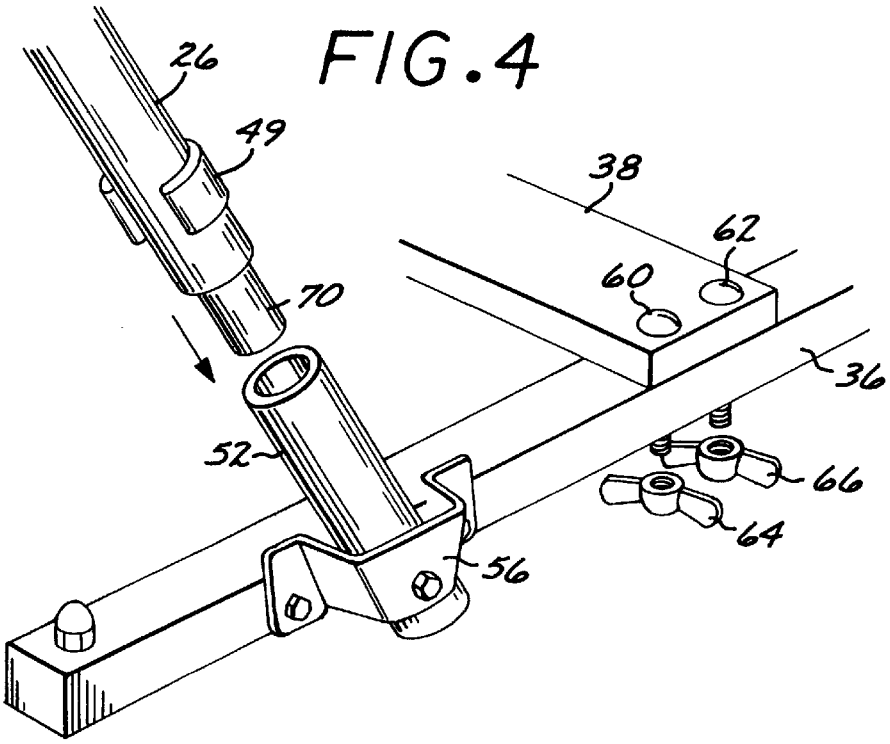
FIG. 4 is a detailed view of a portion of FIG. 3.

Referring now to FIGS. 3 and 4, the assembly of table 10 is illustrated. A pair of short tubular members 50 and 52 are pivotably mounted in brackets 51 and 53, respectively. The disassembled table tennis table 10 comprises five pieces; table portion 12, table portion 14, parallel frame members 34 and 36 and connecting member 38. During the assembly process, the customer places the connecting member 38 between the two parallel members 34 and 36 in a manner such that holes formed in each end portion of the connecting member 38 are aligned with corresponding holes in the members 34 and 36, as illustrated. Four bolts (only bolts 60 and 62 are illustrated) are placed in the aligned holes and wing nuts (only nuts 64 and 66 are illustrated) are utilized to fasten connecting member 38 to the frame members 34 and 36. Table portion 12 is then joined to the lower assembly of components 34, 36 and 38 by inserting ends 68 and 70 of tubular members 26 and 28, respectively, in corresponding short tubular members 50 and 52 on frame members 34 and 36. As shown in FIG. 4, portion 70 of tubular member 26 is in the process of being inserted into tubular member 52. FIG. 3 illustrates both tubular portions 68 and 70 in the process of being inserted into corresponding tubular members 50 and 52. In the assembled and folded position shown in FIG. 2, table portions 12 and 14 are positioned at an angle to the vertical, the edges thereof being adjacent to each other but not in contact.

Figure 5:
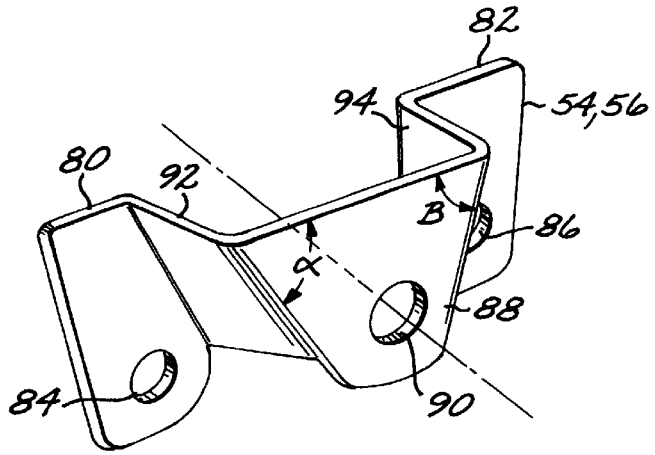
FIG. 5 is a perspective view of the bracket used to position the table portions in the unfolded state.

Referring now to FIG. 5, the detail of bracket members 54 and 56 is illustrated. The bracket comprises ear portions 80 and 82, mounting holes 84 and 86, respectively, formed therein and a center portion 88 having a pivot hole 90 formed therein as illustrated. Bracket portion 92 joins portion 80 to the center portion 88 and portion 94 joins end portion 82 to the center portion 88. Portions 92 and 94 are formed at a angle $\alpha$ and $\beta$ to center portion 88, respectively. Angle $\alpha$ is selected to allow the table portion 12 to have an intermediate position as it is being moved to its unfolded state, and angle $\beta$ prevents the edges of the table portions 12 and 14, when in the folded state, from touching. The angles $\alpha$ and $\beta$ are variable and depend on the diameter of casters 40 since it is desired to maintain the height of the assembled table to a specific value, such as 30 inches. In particular, the height of frame members 34 and 36 from ground because of the caster diameter will cause $\alpha$ and $\beta$ to vary. Typically, $\alpha$ is less than $\beta$ and $\alpha$ is less than 90 degrees. The function of bracket angle $\alpha$ is to prevent the bottom edges 61 and 61' of table portions 12 and 14, respectively, when one of the portions is in the process of opening, or unfolding, from contacting or otherwise touching the other table portion. The function of angle $\beta$ is to prevent the top edges 63 and 65 of table portions 12 and 14, respectively, from contacting when the table 10 is in the closed, or fully folded, position.

Figure 6:
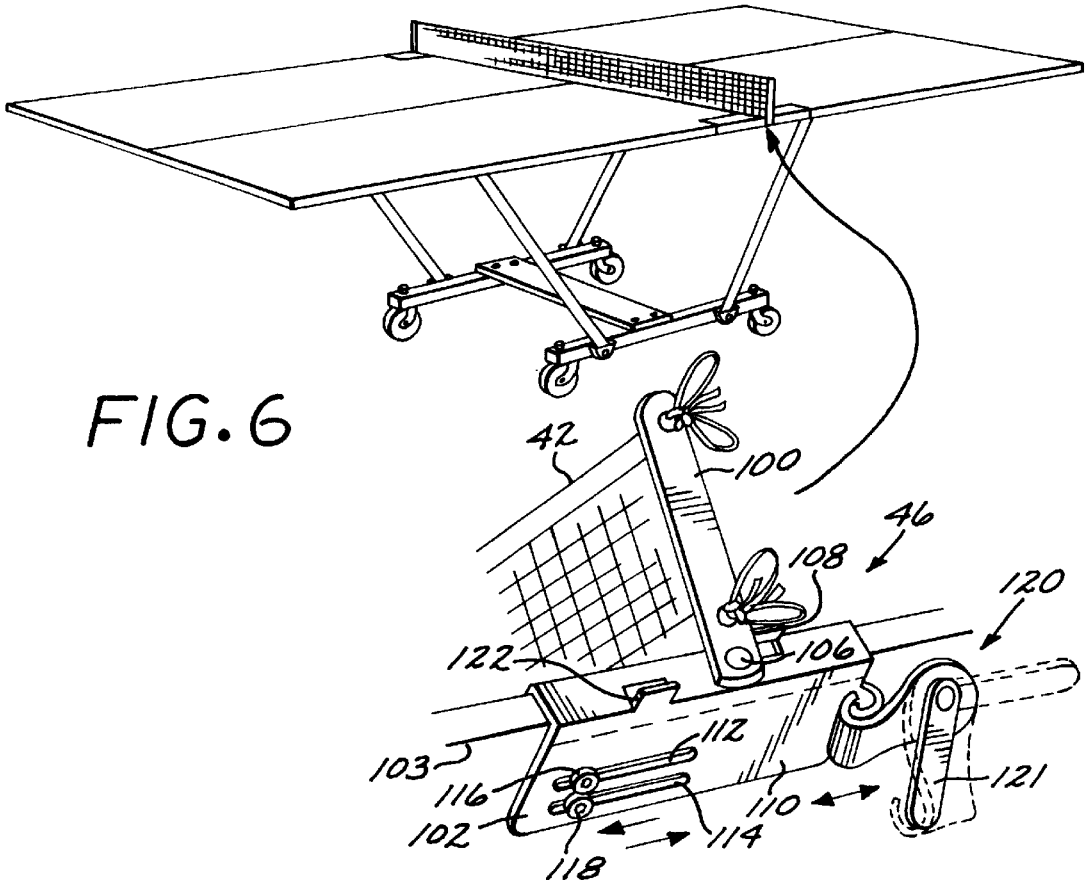
FIG. 6 is a perspective view of the bracket mechanism which enables the net to remain on the table during the folded state.

Referring now to FIG. 6, a detail of the bracket portion 46 which allows the net 42 to be retained on the table 10 when the table is in the collapsible or unfolded state, is illustrated. Bracket 46 comprises a vertical portion 100 and a U-shaped portion 102 having a recess, or channel, 103. Vertical portion 100 has holes formed therein to receive the tie portion of the net 42 in a conventional manner. The bottom of vertical portion 100 is joined to portion 102 by a pivotable member 106. A stop member 108 is positioned against the bottom of vertical portion 100 as illustrated. Bracket 46 has a substantially flat bottom portion 110 which is positioned against the bottom surface of table portions 12 and 14, overlapping the gap between the facing edges of table portions 12 and 14.

Grooves 112 and 114 are formed in the bottom surface 110 and pins 116 and 118 are positioned in grooves 112 and 114, respectively. In the playing position shown in FIG. 6, bracket member 46 is moved into position to bridge the separating gap between table portions 12 and 14 and is locked into position by locking member 120. In this position, the bottom portion of vertical member 100 engages stop member 108. As illustrated, when in the locked position, the bottom portion of vertical member 100 is forced against stop member 108, which in turn causes the member 100 to pivot to its vertical position and no further. Bracket portion 46, in the operational position, thus provides an additional support for table potions 12 and 14. When it is desired to collapse the table, handle 121 of locking member 120 is released and vertical portion 100 is folded down on the upper surface of table portion 12. In addition, bracket 46 is moved along the edge of table portion 12 away from the gap between table portions 12 and 14, allowing the table to be collapsed, or folded, to the position shown in FIG. 2.

Figure 7:
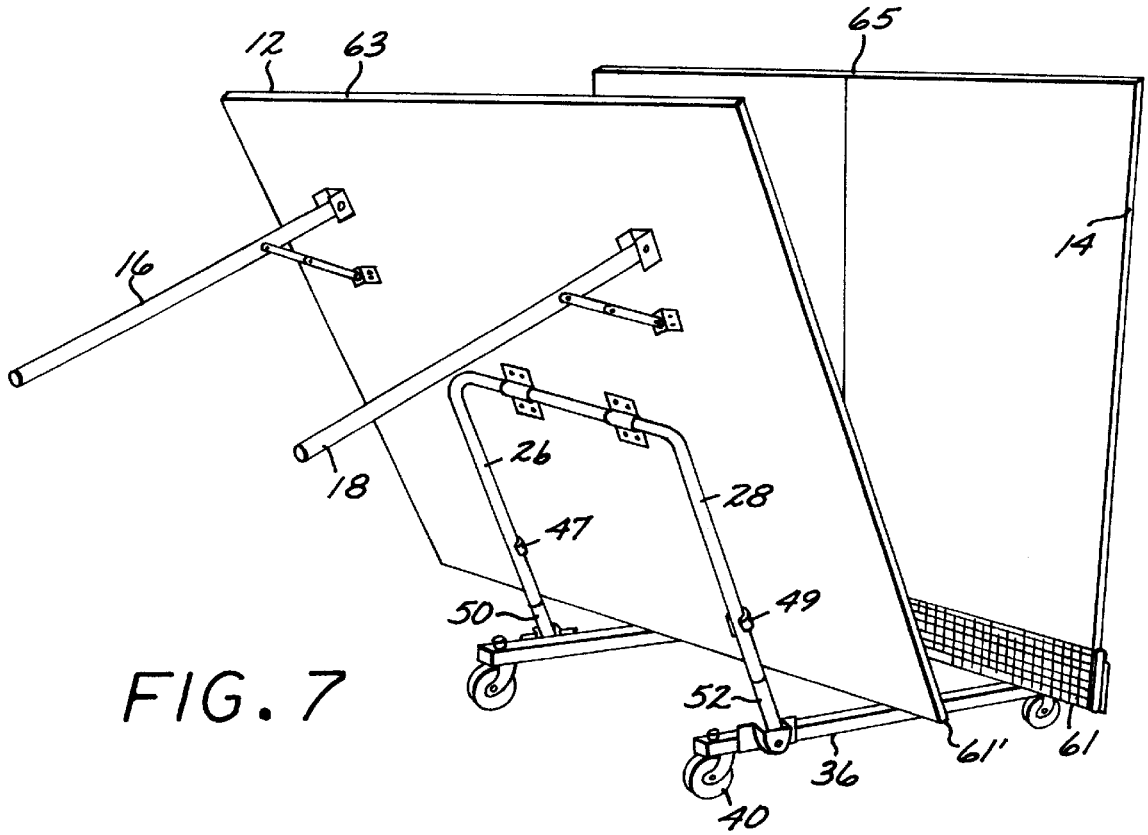
FIG. 7 is a perspective view of the present invention illustrating the completion of the transition from the folded to an unfolded state.
Figure 8:
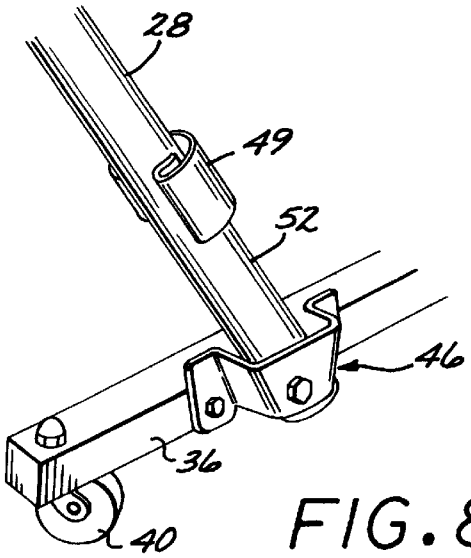
FIG. 8 is a detailed view of a portion of FIG. 7.

FIG. 7 shows the table 10 assembled and in the intermediate unfolded position with legs 26 and 28 inserted into corresponding tubular portions 50 and 52, respectively, and legs 16 and 18 in the fully extended position. FIG. 8 is a detail of a portion of FIG. 7 showing legs 26 and 28 inserted into tubular members 50 and 52, respectively.

Figure 9:
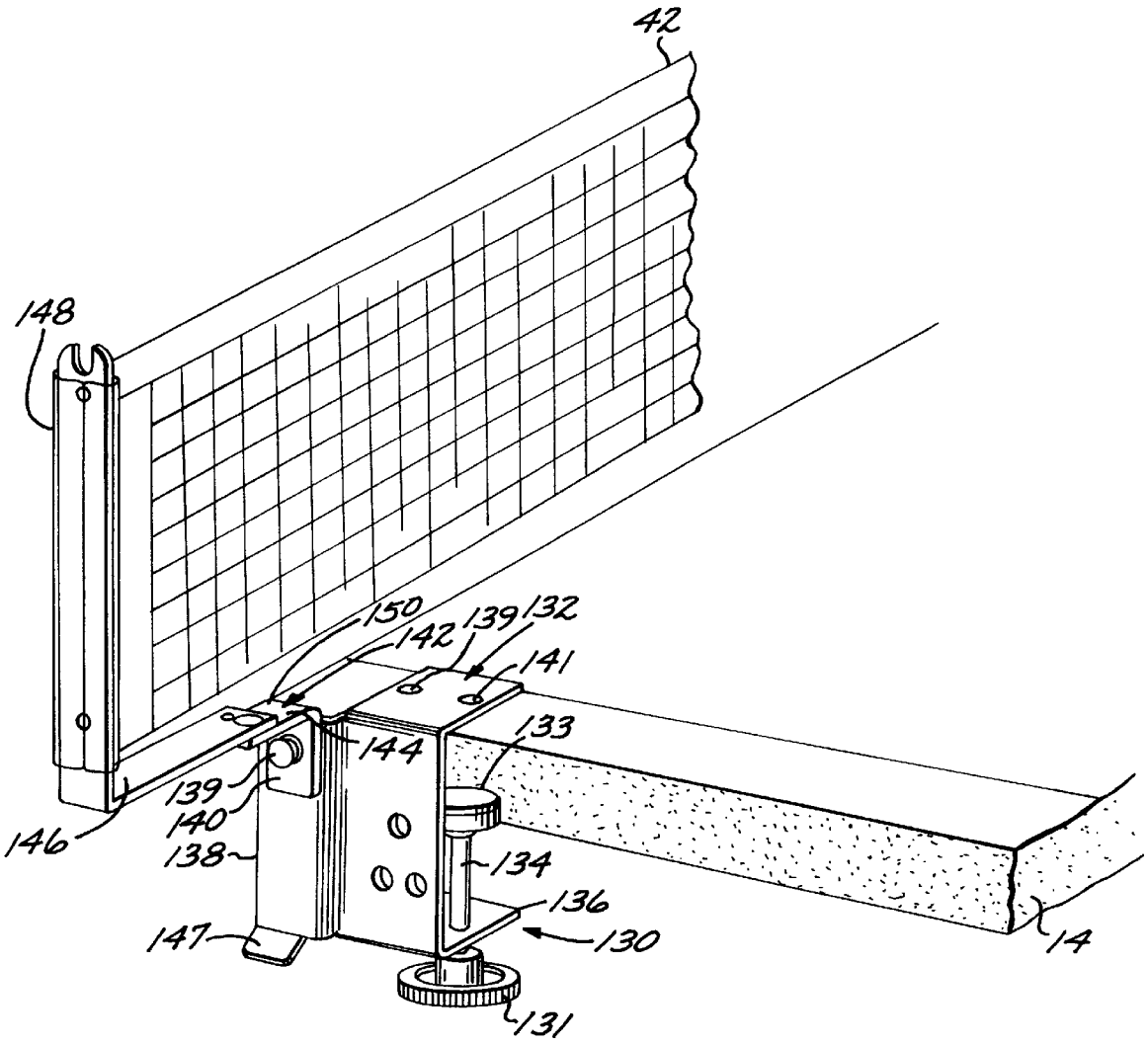
FIGS. 9–14 illustrate two additional embodiments of a tennis net mounting bracket.
Figure 10:
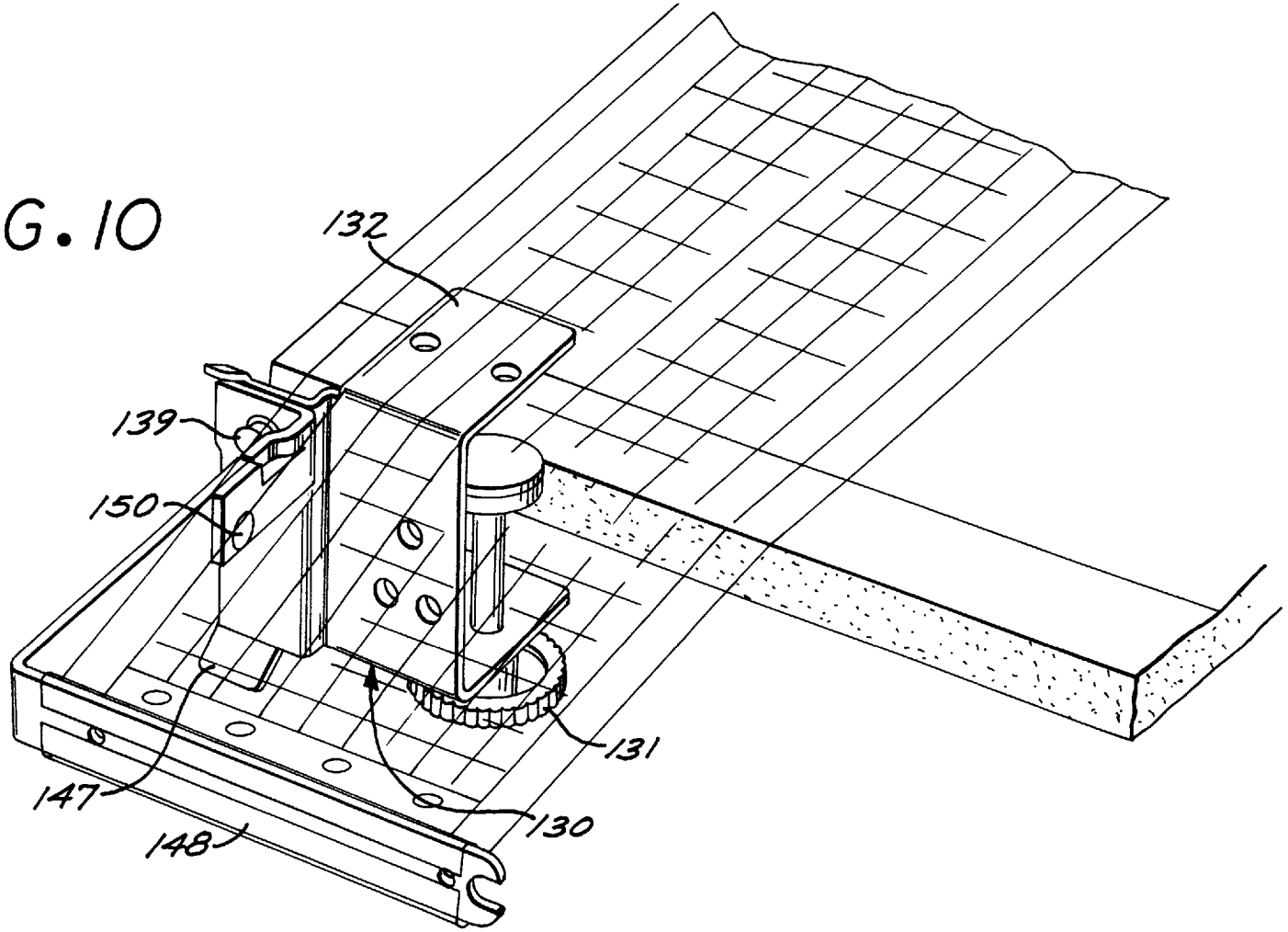
Figure 11:
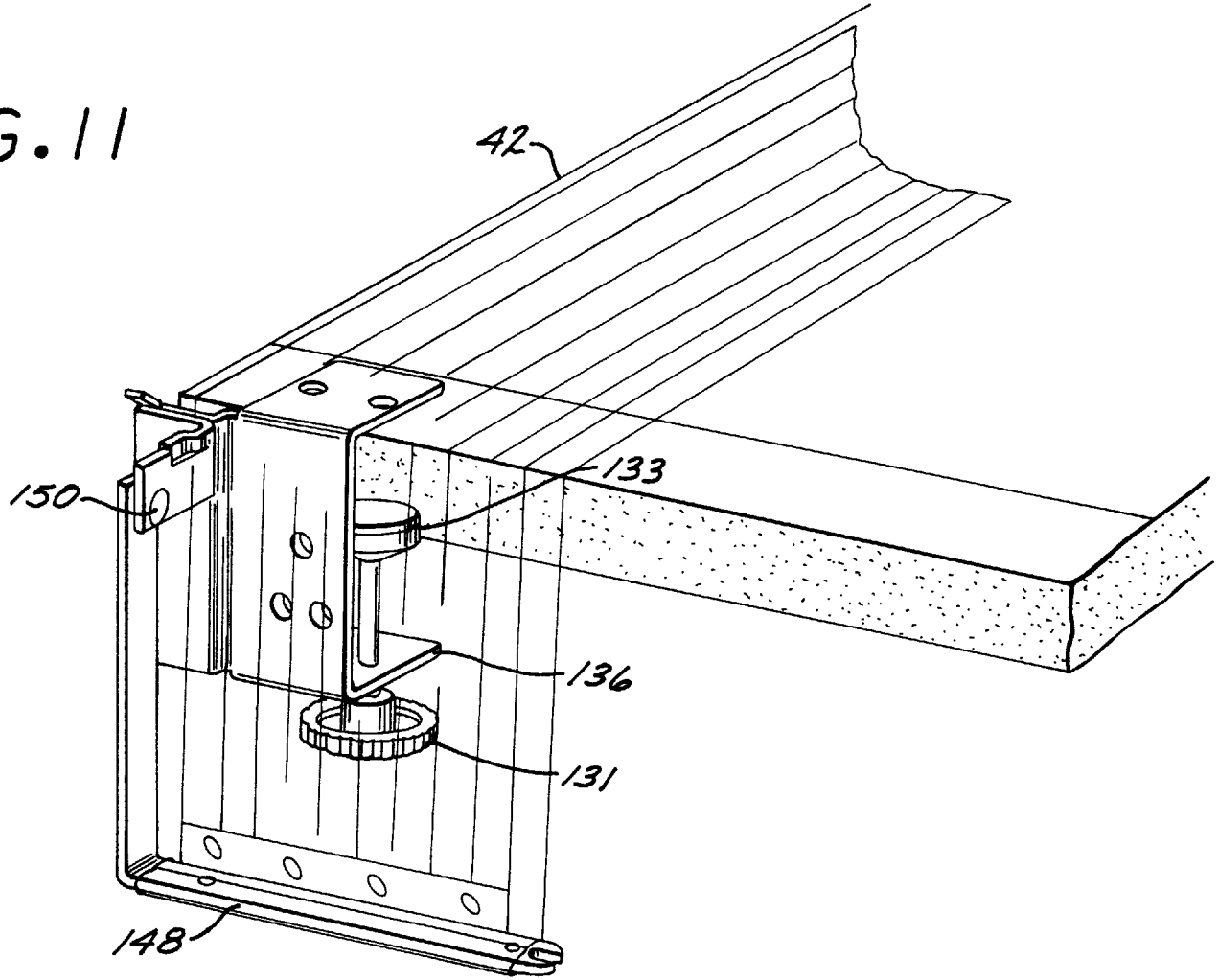

Referring now to FIGS. 9–11, a second embodiment of a mounting bracket member which can be utilized in the present invention to permanently attach a tennis net to the table is illustrated. It should be noted that only one bracket member has been illustrated in this and the other embodiments set forth herein although an identical member is positioned on the opposite edge of table 10.

FIG. 9 illustrates mounting bracket member 130 supporting net 42 in the upright, or play, position. Bracket member 130 comprises U-shaped member 132 having a clamp device 134 extending through an aperture formed in leg 136 of member 132 (although not shown in the clamped position, rotation of knob 131 causes end, or cup, member 133 to engage the bottom surface of table portion 14, thus securing the bracket member 130 to table 10), leg 137 including apertures 139 and 141 for receiving fastener members to permanently secure bracket 130 to table portion 14. A second channel member 138 extends from and is connected to member 132 as illustrated. A pivot pin 139 is positioned in leg 140 of a L-shaped member 142, leg 144 of member 142 being connected to leg 146 of net bracket 148 by fastener member 150. Two tab members (only tab member 147 is illustrated) are formed as part of bracket member 130 and function to guide table portion 12 into alignment with the edge of table portion 14 as it is moved to the unfolded position.

FIG. 10 illustrates the situation when net bracket 148 is rotated about pivot 139 so that net 42 lies essentially flat against the top surface of table portion 14.

FIG. 11 illustrates the situation when net bracket 148 is rotated about fastener member 150 so that net 42 rests tightly against the top of table portion 14 and wherein the ends of the net/bracket extending beyond the edges of table 10 are positioned in a manner to avoid injuring a passerby.

Figure 12:
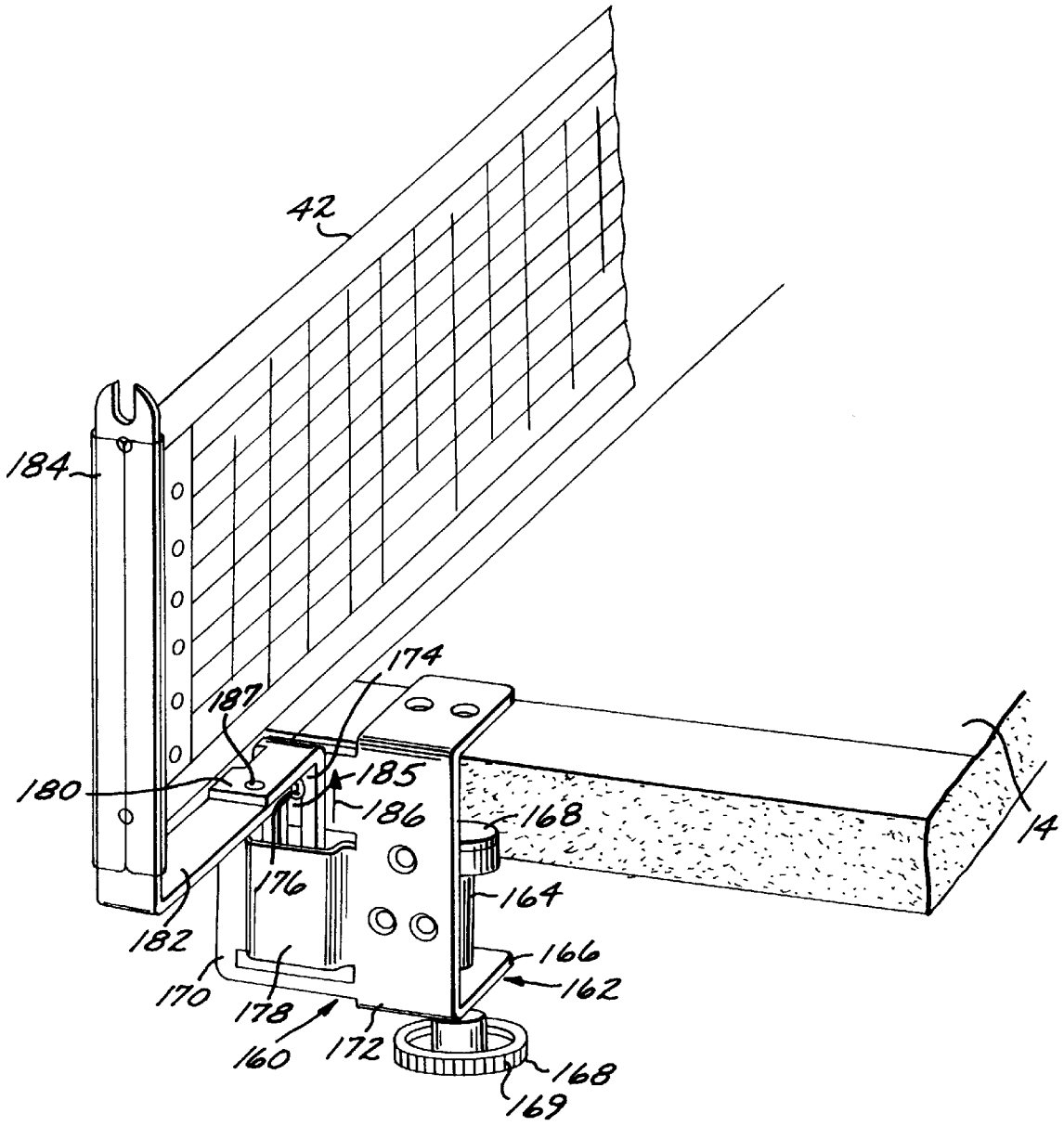
Figure 13:
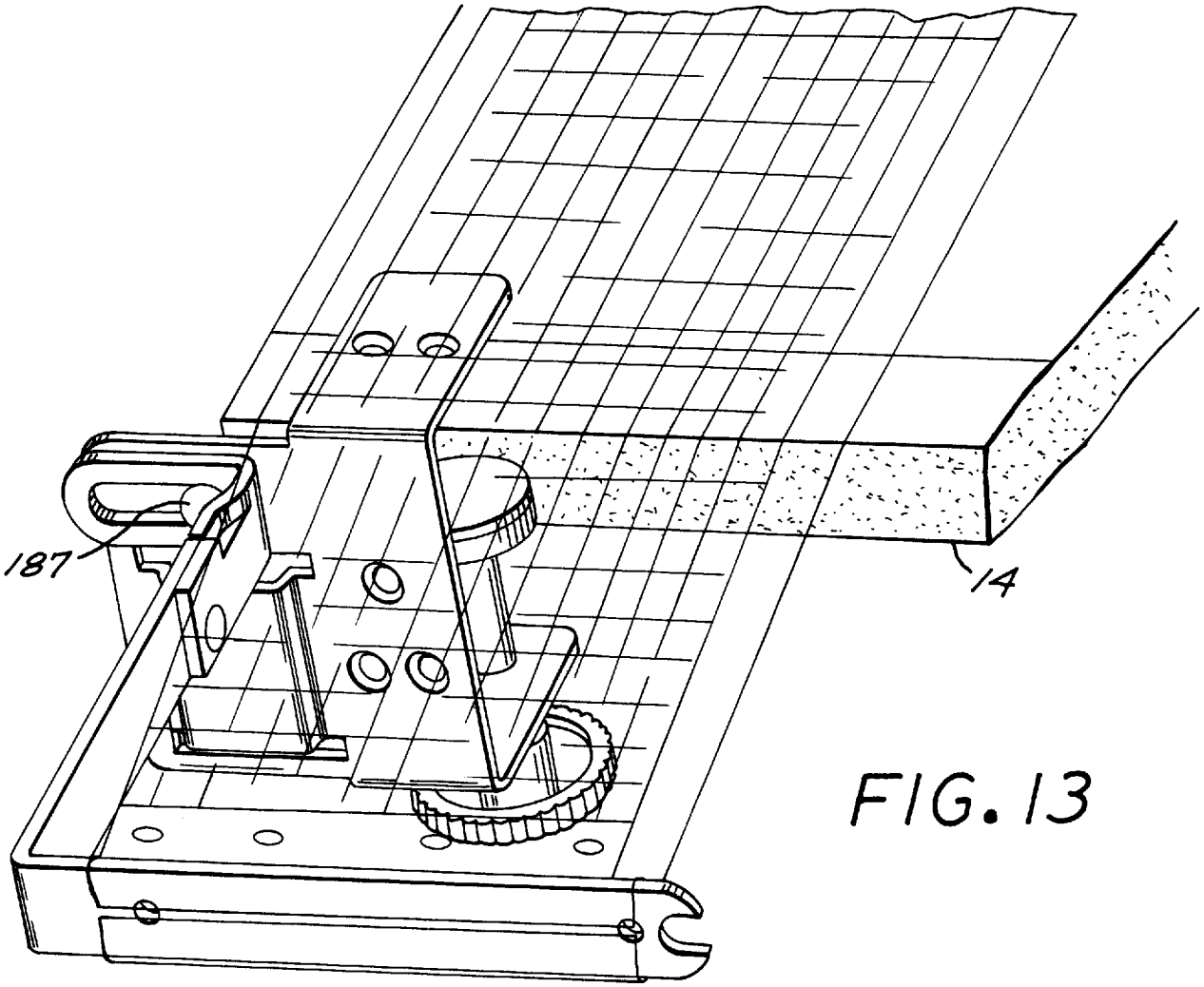
Figure 14:
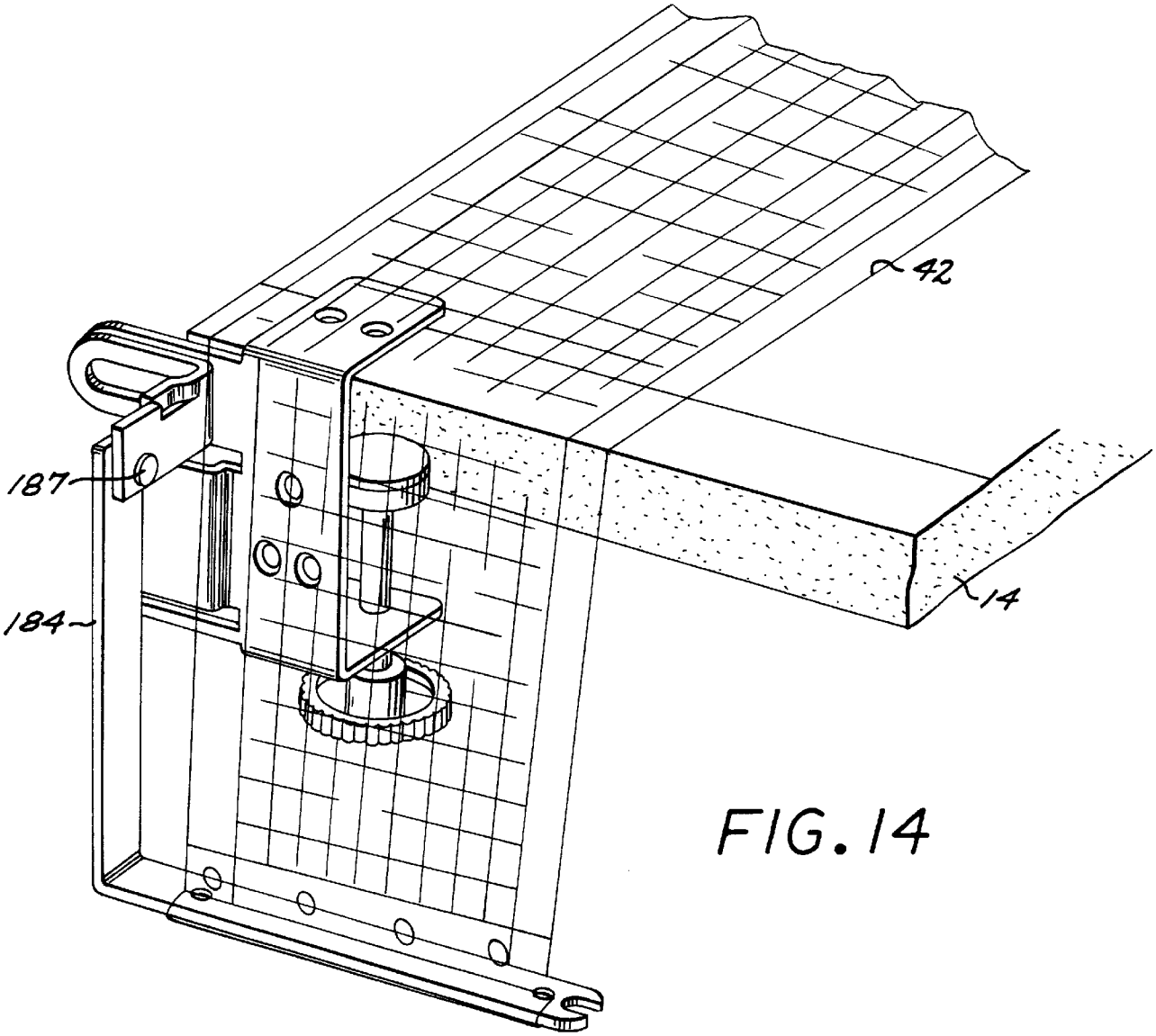

Referring now to FIGS. 12–14, a third embodiment of a mounting bracket which can be utilized in the present invention to permanently attach a tennis net to table 10 is illustrated.

FIG. 12 illustrates mounting bracket 160 supporting net 42 in the upright, or play, position. Bracket member 160 comprises U-shaped member 162 having a clamp device 164 extending through an aperture formed in leg 166 of member 132. Rotation of knob 169 causes end, or cup, member 168 to engage the bottom surface of table portion 14, thus securing bracket member 160 to table 10. A horizontal plate member 170 is attached to elongated member 172 of U-shaped member 162. A slotted L-shaped member 174 is movable along guide pin 176 within bracket 178, end 180 of member 174 being connected to leg portion 182 of tennis net bracket 184. To place the net 42 in the store position, bracket 184 is pulled in the vertical direction such that member 174 is moved in the direction of arrow 186 within channel 185. Tennis bracket is then rotated to the store position as shown in FIG. 13 so that net 42 is in the horizontal direction against the top surface of table portion 14 as illustrated.

FIG. 14 illustrates the final storage position with the bracket member rotated about pivot pin 187 so that net 42 rests tightly against the surface of table portion 14.

The present invention thus provides a simply constructed collapsible tennis table which requires few parts, no installation tools, allows the net to remain on the table when the table is folded and allows the table, during the unfolded state, to be moved in two steps thus allowing the table to be moved easily and minimizing the possibility of injuring the user if the table was unfolded in one movement.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A collapsible table comprising:

a first table portion, said first table portion having first and second edges and top and bottom surfaces;

a second table portion, said second table portion having first and second edges and top and bottom surfaces; said first and second table portions being adapted to be moved to either a first or second position relative to a horizontal plane;

a wheel base unit comprising first and second substantially parallel elongated members and a member connecting said first and second parallel members;

first and second receiving members coupled to said first and second parallel members, said first and second receiving members each having first and second end portions; and first and second leg portions each having one end secured to the bottom surface of said first table portion, the other end of said first and second leg portions being coupled to the first end portion of said first and second receiving members, respectively, whereby said first table portion is connected to said wheel base unit.

2. The table of claim 1 wherein said second end of said first receiving member member is pivotably secured within a bracket member having first and second angled sides, said first receiving member being in contact with said first angled side when said first table portion is in said first position and in contact with said second angled side when said first table portion between said first and second positions.

3. The table of claim 2 wherein said first angled side of said bracket member prevents the first edges of said first and second table portions from being in contact when said first and second table portions each are in said first position.

4. The table of claim 3 wherein said bracket member prevents the second edge of said first table portion from being in contact with said second table portion as said first table portion moves from said first position towards said second second position.

5. The table of claim 1 wherein a net is secured to the top surface of said first table portion by bracket means.

6. The table of claim 5 wherein said net is pivotably connected to said bracket means in a manner whereby said net remains on said first table portion when said first table portion is in the first or second positions.

7. The table of claim 6 wherein said bracket means is adapted to enable the net to fold in more than one plane relative to the top surface of said first table portion.

8. The table of claim 1 further including third and fourth receiving members coupled to said first and second parallel members and third and fourth leg portions each having one end secured to the bottom surface of said second table portion, the other end of said third and fourth leg portions being coupled to said third and fourth receiving members, respectively, whereby said second table portion is connected to said wheel base unit.

9. The table of claim 8 wherein at least one aperture formed at both ends of said connecting member are aligned with apertures formed in said first and second elongated members, fastener members being positioned in said apertures to secure said connecting member to said first and second elongated members thereby coupling said first elongated member to said second elongated member.

10. The table of claim 8 further including first releasable securing means mounted to the bottom surface of said first table portion, said first securing means releasably holding said first and second leg portions adjacent the bottom surface of said first table portion when said first table portion is in said first position.

11. The table of claim 10 wherein said first and second leg portions are released from said first releasable securing means when said first table portion is moved towards said second position.

12. The table of claim 11 further including second releasable securing means mounted to the bottom surface of said second table portion, said second releasable securing means releasably holding said first and second leg portions of said second joining means adjacent to the bottom surface of said second table portion when said second table portion is in said first position.

13. The table of claim 12 wherein said third and fourth leg portions of said second table portion are released from said second securing means when said second table portion is moved towards its second position.

* * * * *